US005236194A

United States Patent [19]

Mohtasham et al.

[11] Patent Number: 5,236,194

[45] Date of Patent: Aug. 17, 1993

[54] GAME WITH INTERCHANGEABLE PIECES

[76] Inventors: Mani Mohtasham, 10665 SW. 76 Ter.; Hamid M. Gharagozloo, 7896 SW. 106 Cir., both of Miami, Fla. 33173

[21] Appl. No.: 923,460

[22] Filed: Aug. 3, 1992

[51] Int. Cl.[5] ..... A63F 3/00

[52] U.S. Cl. ..... 273/267

[58] Field of Search ..... 273/267, 269, 268, 282, 273/283, 288

[56] References Cited

U.S. PATENT DOCUMENTS

| | | | |
|---|---|---|---|
| 1,388,505 | 8/1921 | Bamforth | 273/267 |
| 3,460,834 | 8/1969 | Nickel | 273/267 X |
| 3,768,811 | 10/1973 | Goldfarb et al. | 273/267 X |
| 3,863,926 | 2/1975 | White et al. | 273/267 |
| 4,277,066 | 7/1981 | Hough | 273/267 |

FOREIGN PATENT DOCUMENTS

| | | | |
|---|---|---|---|
| 715927 | 8/1965 | Canada | 273/267 |
| 758568 | 10/1956 | United Kingdom | 273/267 |
| 1321071 | 6/1973 | United Kingdom | 273/267 |

OTHER PUBLICATIONS

"Box Clever", *Games and Puzzles,* 1977, p. 20.

*Primary Examiner*—W. Stoll

*Attorney, Agent, or Firm*—Malloy & Malloy

[57] ABSTRACT

To be played by two or more players, a game with interchangeable pieces, including, at least one gameboard having a base and an upper exposed surface, the upper exposed surface defining a play area which is divided into a plurality of similarly oriented, geometrically shaped scoring sections, defined by a plurality of peripheral edge portions at least two distinct sets of identifying scoring pieces, and at least two distinct sets of boarder pieces, each player having an individually identifiable set of the scoring pieces and the boarder pieces, the boarder pieces being removably positionable along a select one of the peripheral edge portions of one of the scoring sections, such that each of the scoring sections may be enclosed by placing one of the boarder pieces along all of the peripheral edge portions of that scoring section, and the scoring pieces being similarly securable within an enclosed one of the scoring sections. The game further including a plurality of playing cards, each having indicia printed thereon corresponding to indicia on select ones of the scoring sections of the playing area, such that the selection of one of the playing cards may be clearly designated.

11 Claims, 4 Drawing Sheets

GAME WITH INTERCHANGEABLE PIECES

BACKGROUND OF THE INVENTION

Field of the Invention

This invention relates to a game having interchangeable pieces, to be played by two or more persons, thereby providing an effective means of entertainment for the individuals.

SUMMARY OF THE INVENTION

The present invention is directed to a game having interchangeable pieces, to be played by two or more persons. The game includes primarily at least one gameboard having a base and an upper exposed surface. The upper exposed surface of the gameboard defines a play area Which is divided into a plurality of similarly oriented, geometrically shaped scoring sections. Each of these scoring sections is defined by a number of peripheral edge portions, and includes an open central portion. The game further includes at least two distinct sets of boarder pieces, each set of boarder pieces identifying a particular player and each boarder piece being removably positionable along a selected peripheral edge portion of one of the scoring sections, by attachment means. Accordingly, each of the scoring sections may be completely enclosed by the boarder pieces, each of the boarder pieces being substantially the same length as the peripheral edge portions of the scoring sections such that only one of the boarder pieces will generally be needed along each peripheral edge portion. Further included are at least two sets of identifying scoring pieces, each set of scoring pieces representing an individual player. Each scoring piece may be removably secured by holding means within the open central portion of an enclosed one of the scoring sections, thereby denoting its capture by a particular player. Finally, the game includes a plurality of playing cards, each of the cards having indicia printed thereon which corresponds with indicia on select ones of the scoring sections of the play area, which when captured designate that a playing card having matching indicia thereon must be drawn.

BRIEF DESCRIPTION OF THE DRAWINGS

For a fuller understanding of the nature of the present invention, reference should be had to the following detailed description taken in combination with the accompanying drawings in which.

Like reference numerals refer to like parts throughout the several views of the drawings.

DETAILED DESCRIPTION OF THE PREFERRED EMBODIMENT

Figure 1:
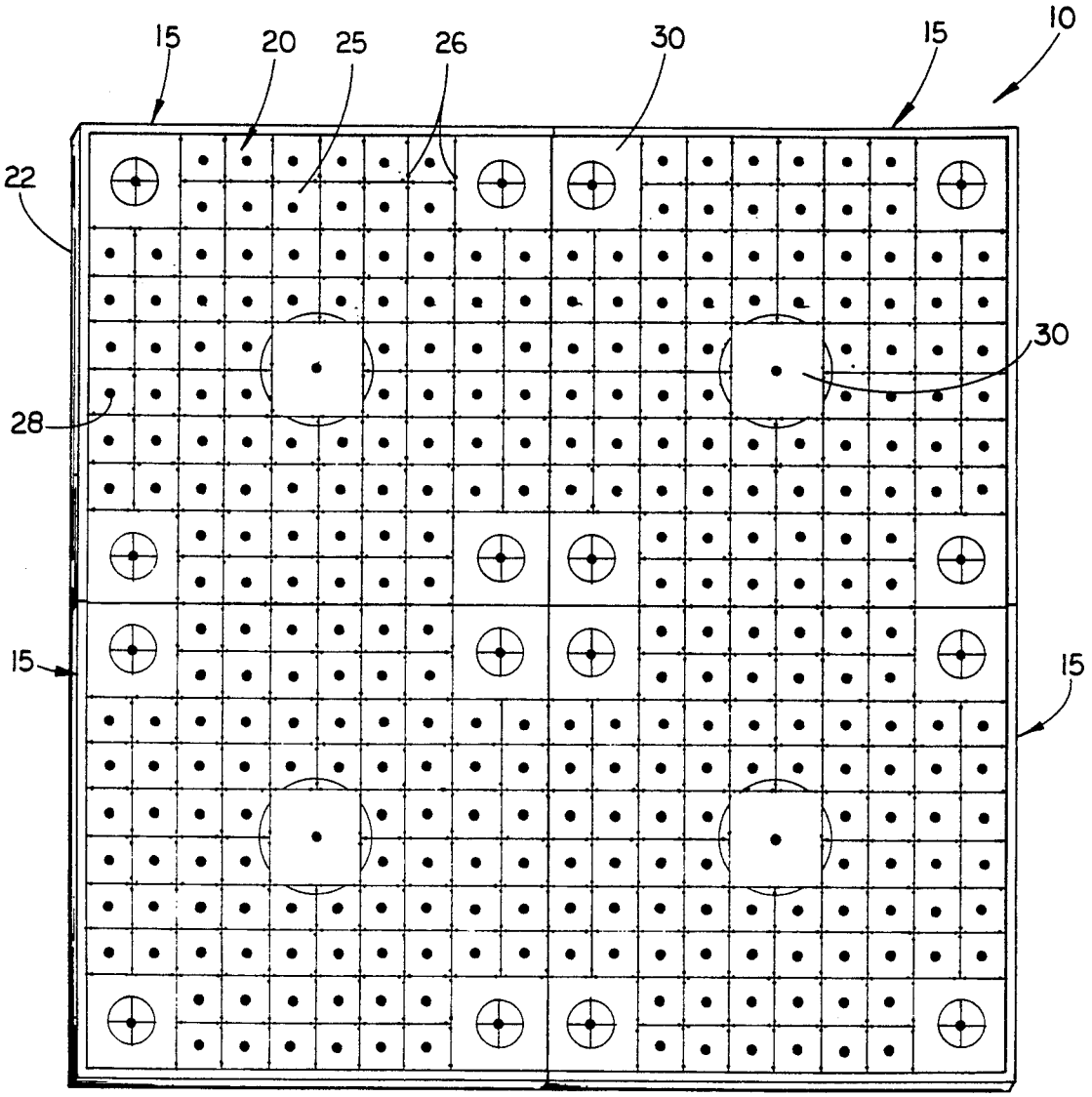
FIG. 1 is a perspective view of the gameboard.
Figure 2:
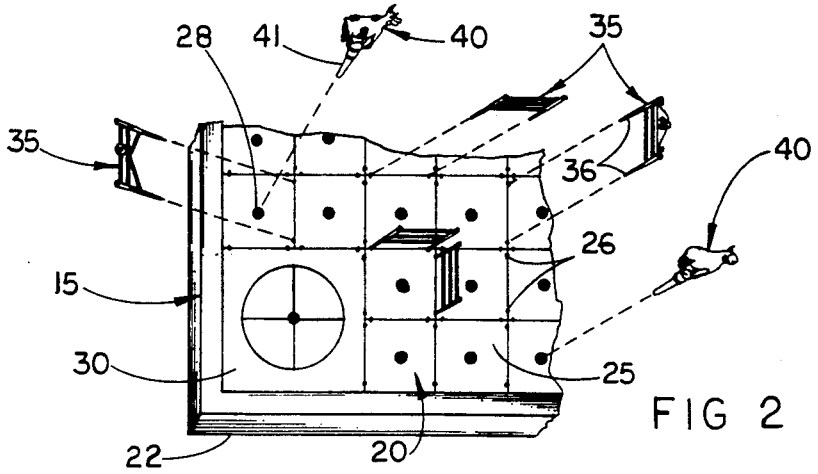
FIG. 2 is a partial cutaway view of the gameboard and game pieces.

As shown throughout FIGS. 1–7, the present invention is directed towards a game with interchangeable pieces, generally indicated as 10. As shown in FIG. 1, the game 10 includes a gameboard 15, of which in a preferred embodiment, there are four positioned in abutting relation to one another. Each of the gameboards 15 includes a base 22 and an upper exposed surface 20 which defines the playing area. This playing area 20 is segmented to include a number of scoring sections 25, which in the preferred embodiment are squares. Each of the individual scoring sections 25 is defined by a plurality of peripheral edge portions, of which there are four in the preferred embodiment, and include an open central portion. In addition to the smaller, uniformly sized scoring sections 25, there are a plurality of bonus scoring sections 30 which are generally larger than the ordinary scoring sections 25.

Figure 3:
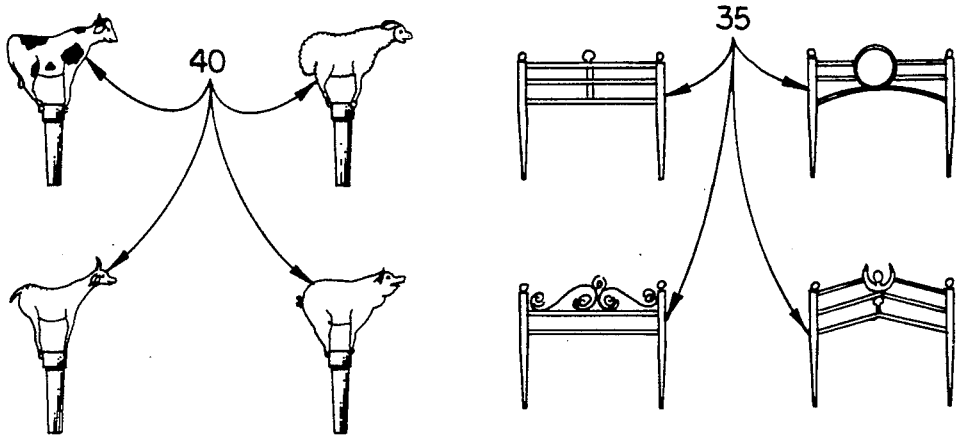
FIG. 3 is a detailed view of the game pieces.

As shown in FIG. 3, the game 10 additionally includes a number of sets of scoring pieces 40. Each set of scoring pieces 40 is distinguishably structured from the scoring pieces 40 of another player, and as shown in the preferred embodiment, may be in the form of animals. Additionally, a number of sets of boarder pieces 3 are included. Similarly, each set of boarder piece 35 is structured so as to identify an individual player, and may be in the form of gates as shown in the preferred embodiment.

Turning back to FIGS. 1 and 2, the boarder pieces 35 are structured so as to be positionable along a peripheral edge portion between adjacent scoring sections 25, and extend completely along the selected peripheral edge portion of the scoring section 25. As a result of the larger size of the bonus scoring sections 30, more than one boarder section 35 may be needed to completely boarder a select peripheral edge portion of the bonus scoring section 30. In order to facilitate the positioning of the boarder pieces 35, each boarder piece 35 includes an elongate peg 36 extending from a bottom portion thereof which is structured to be positioned within selected apertures 26 in the gameboard 15, which extend along the peripheral edge portions of the scoring sections 25 and bonus scoring sections 30. These apertures 26 are positioned such that each individual scoring section 25, or bonus scoring section 30 may be completely enclosed by the boarder pieces 35. Further, abutting edges of each gameboard 15 include half aperture which when joined with a half aperture on an abutting gameboard 15 form a complete aperture 26. As illustrated in FIG. 1, no apertures 26 are disposed along a perimeter of the playing area 20 as the perimeter is implicitly enclosed. Positioned in the open central portion of each scoring section 25 and bonus scoring section 30 is a single aperture 28. This single aperture 28 is structured to receive therein a protruding peg 41 which extends from each of the scoring pieces 40. Accordingly, when a scoring section 25 or bonus scoring section 30 is completely enclosed by the boarder pieces 35, the scoring piece 40 may be inserted therein to identify the player capturing the scoring section 25 or bonus scoring section 30.

Figure 4:
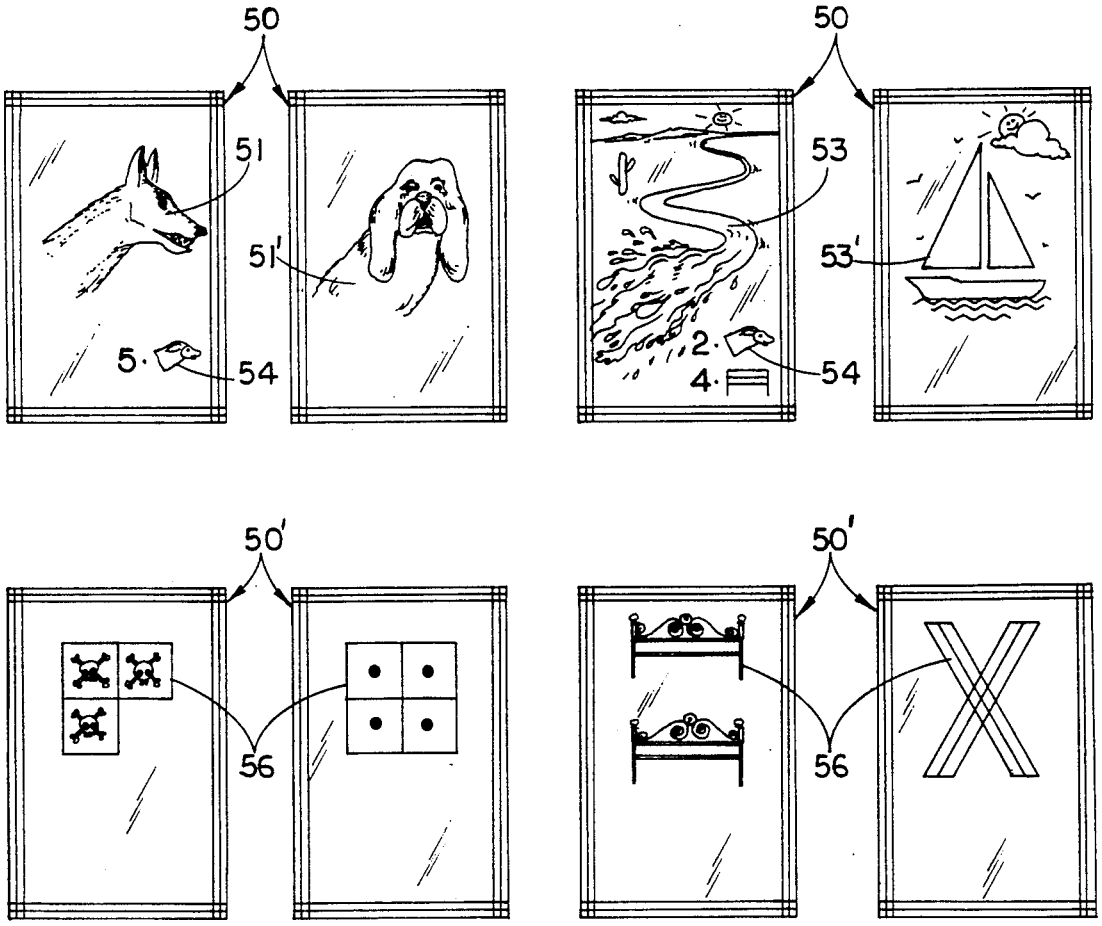
FIG. 4 is a detailed view of the playing cards.
Figure 5:
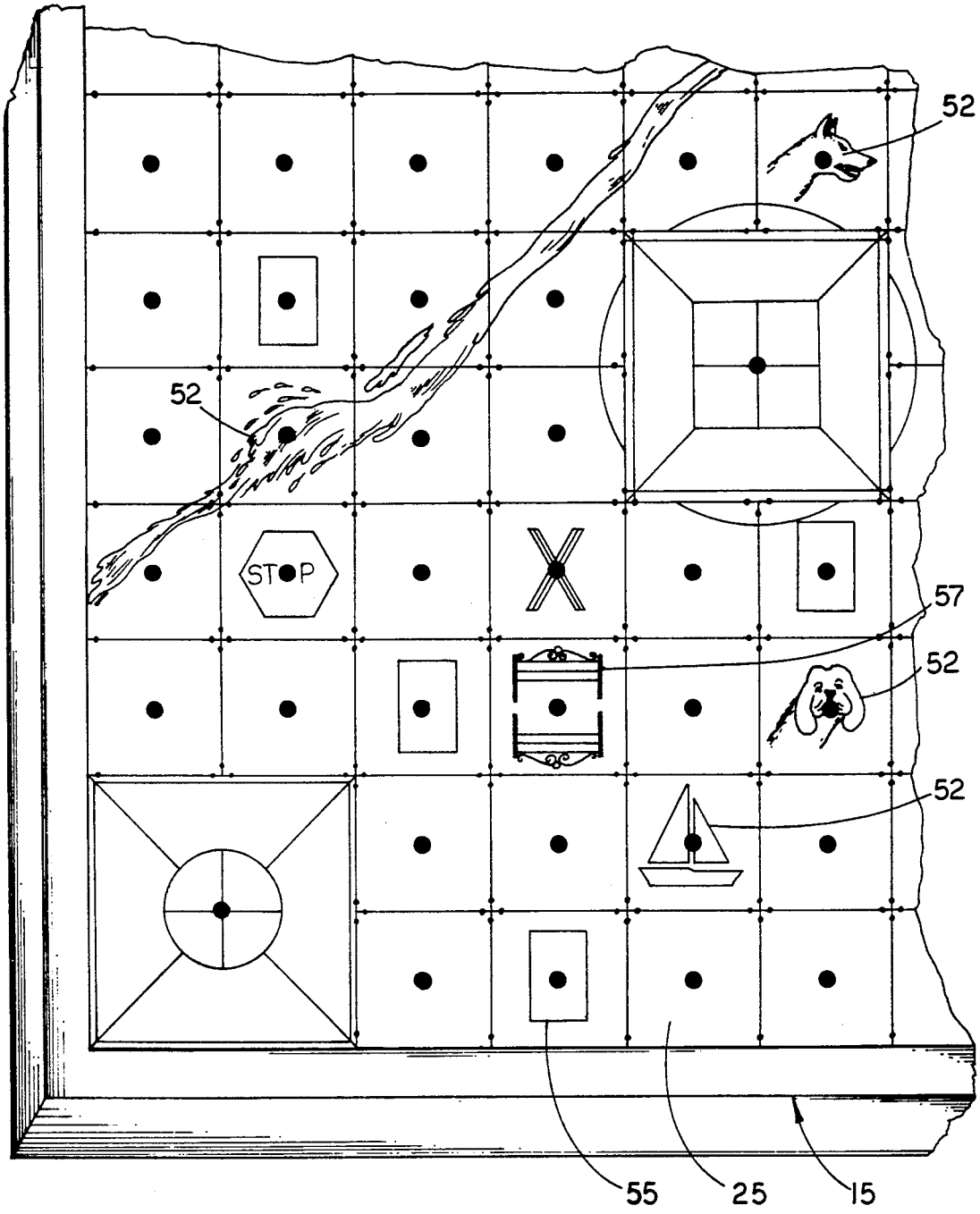
FIG. 5 is a detailed partial cutaway of the gameboard showing the indicia thereon.

Turning to FIG. 4, the game 10 includes a plurality of playing cards 50. Each playing card 50 includes indicia on a face thereof. The indicia on the playing cards 50 may include hazard denoting indicia 51 and 53, or hazard counterbalancing indicia 51' and 53'. The playing cards 51' and 53' correspondingly negate the hazard cards 51 and 53 if they are held when the hazard cards 51 and 53 are drawn. Should the counterbalancing cards 51' and 53' not be held when hazard cards 51 and 53 are drawn, indicia 54 denoting player actions, such as the loss of a previously positioned scoring piece 30 or boarder piece 35, must be followed by the player drawing the hazard card 51 or 53. A hazard 51 or 53, or counterbalancing card 51' or 53' are drawn when a scoring section 25 having corresponding indicia 52 thereon, as detailed in FIG. 5, is captured and enclosed by the player. Additionally, a scoring section 25 include indicia 55 indicating that a general card, whose identity is unknown must be drawn. These general cards, which are disposed face down until drawn, in addition to being hazard cards 51 or 53, or counter-balancing cards 51' or 53' may include indicia 56 thereon, as illustrated on general cards 50' in FIG. 4, which indicate player actions, such as losing a turn, getting an extra turn, or losing or gaining points, which must be taken. Further, individual scoring sections 25 may include indicia 57 which when enclosed direct player actions, much like those resulting from drawing a general card, which must be taken without the need to draw a card.

Figure 6:
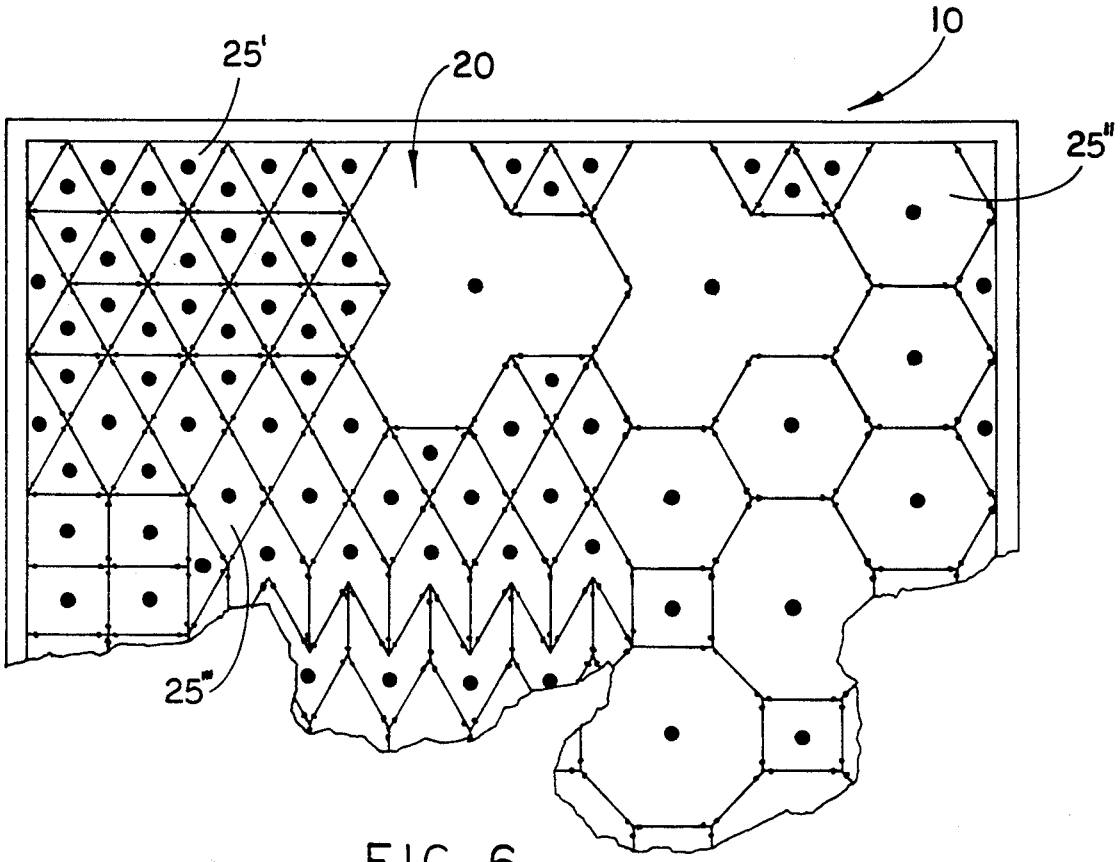
FIG. 6 is a partial cutaway view of the gameboard showing numerous shapes of scoring sections.
Figure 7:
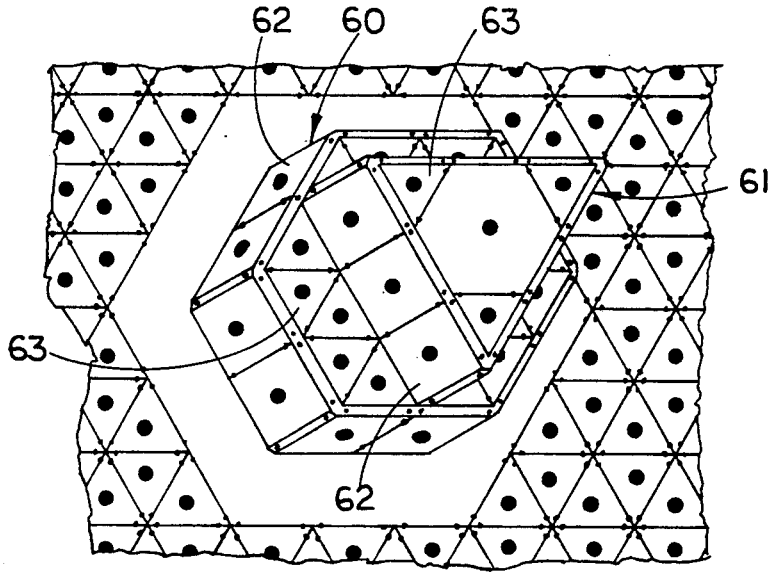
FIG. 7 is an alternative embodiment of the game having multiple levels.

Turning to FIGS. 6 and/ 7, the play area 20 may take a variety of configurations. As shown in FIG. 6, the individual scoring sections may be in the form of triangles 25', hexagons 25'', diamonds 25''', or any other geometric shape or combination thereof. Further, as detailed in FIG. 7, a plurality of levels 60 and 61 may be included such that vertical faces 62 and upper exposed surfaces 63 may also be played upon.

Applicant's invention as shown indicates the preferred embodiment of the invention, however, the concept may be easily adapted for use with a variety of themes of scoring and boarder pieces, such as children's story or cartoon characters. Further, the game may be easily adapted for playing on a computer or video game system. As a result, applicant's invention should not be limited beyond what is required by the doctrine of equivalents.

Now that the invention has been described, what is claimed is:

1. To be played by two or more players; a game with interchangeable pieces, comprising:

at least one gameboard, said gameboard including a base and an upper exposed surface, said upper exposed surface defining a play area, said play area being divided into a plurality of similarly oriented, geometrically shaped scoring sections, each of said scoring sections being defined by a plurality of peripheral edge portions, the number of said peripheral edge portions corresponding to the geometric shape of said scoring section, and including an open central portion, at least two distinct sets of boarder pieces, each set of boarder pieces identifying a particular one of the players, each of said boarder pieces being substantially the same length as said peripheral edge portions of said scoring sections, at least two sets of identifying scoring pieces, each of said scoring pieces representing an individual one of the players, attachment means structured and disposed to removably position individual ones of said boarder pieces along a selected one of said peripheral edge portions of one of said scoring sections, such that each of said scoring sections may be enclosed by placing said boarder pieces along each of said peripheral edge portions of the scoring section, holding means structured and disposed to removably secure individual ones of said scoring pieces within said open central portion of an enclosed one of said scoring sections, said holding means including an aperture in said gameboard positioned in said open central portion of each of said scoring sections, said aperture in each of said scoring sections being structured and disposed to receive a correspondingly sized peg protruding from each of said scoring pieces therein, said play area including a plurality of bonus scoring sections, said bonus scoring sections being larger than said scoring sections and requiring more than one of said boarder pieces to extend along a peripheral edge portion thereof, and a plurality of playing cards, each of said cards including indicia printed thereon corresponding with indicia on select ones of said scoring sections of said play area, so as to designate the selection of one of said playing cards.

2. A game as recited in claim 1 wherein said attachment means includes a pair of apertures in said gameboard, positioned along each of said peripheral edges of said scoring sections, and being structured and disposed to removably receive therein correspondingly sized pegs protruding from each of said boarder pieces.

3. A game as recited in claim 4 wherein said playing cards further include indicia denoting player actions which must be taken.

4. A game as recited in claim 3 wherein said play area further includes indicia indicating player actions which must be taken.

5. A game as recited in claim 4 wherein there are four of said gameboards, structured for abutting, adjoining connection with one another.

6. A game as recited in claim 4 wherein said gameboard includes multiple levels, each of said levels including scoring sections on side and upper exposed faces thereof.

7. A game as recited in claim 4 wherein said boarder pieces are in the form of gates.

8. A game as recited in claim 4 wherein said scoring pieces are in the form of farm animals.

9. A game as recited in claim 4 wherein said geometrically shaped scoring sections are squares.

10. A game as recited in claim 4 wherein at least some of said scoring sections are triangles.

11. A game as recited in claim 4 wherein at least some of said scoring sections are hexagons.

* * * * *